US005421703A

United States Patent [19]

Payling

[11] Patent Number: 5,421,703

[45] Date of Patent: Jun. 6, 1995

[54] POSITIVELY RETAINED VANE BUSHING FOR AN AXIAL FLOW COMPRESSOR

[75] Inventor: Stephen R. Payling, Fairfield, Ohio 45014

[73] Assignee: General Electric Company, Cincinnati, Ohio

[21] Appl. No.: 248,783

[22] Filed: May 25, 1994

[51] Int. Cl.[6] ..... F01D 1/04

[52] U.S. Cl. ..... 415/209.4; 415/209.3

[58] Field of Search ..... 415/209.2, 209.3, 209.4, 415/210.1, 189

[56] References Cited

U.S. PATENT DOCUMENTS

| | | | |
|---|---|---|---|
| 830,878 | 9/1906 | Callan | 415/209.4 |
| 2,744,680 | 5/1956 | Rainbow et al. | 415/209.3 |
| 2,819,871 | 1/1958 | McVeigh | 253/78 |
| 2,957,228 | 10/1960 | Stoddard et al. | 29/156.8 |
| 2,995,294 | 8/1961 | Warnken | 230/132 |
| 3,042,370 | 7/1962 | Welsh | 253/78 |
| 3,325,087 | 6/1967 | Davis | 230/114 |
| 3,695,777 | 10/1972 | Westphal et al. | 415/216 |
| 4,498,790 | 2/1985 | Fisher | 384/428 |
| 4,604,030 | 8/1986 | Naudet | 415/126 |
| 4,792,277 | 12/1988 | Dittberner et al. | 415/160 |
| 4,890,978 | 1/1990 | McLaurin et al. | 415/209 |
| 4,990,056 | 2/1991 | McClain et al. | 415/209 |
| 5,000,659 | 3/1991 | Catte et al. | 415/150 |
| 5,062,767 | 11/1991 | Worley et al. | 415/209.3 |
| 5,073,084 | 12/1991 | Hirst | 415/209.3 |
| 5,074,752 | 12/1991 | Murphy et al. | 415/209.4 |
| 5,078,576 | 1/1992 | Hayton | 415/189 |
| 5,083,900 | 1/1992 | Carletti et al. | 415/209.3 |
| 5,328,327 | 7/1994 | Naudet | 415/209.4 |

FOREIGN PATENT DOCUMENTS

| | | | |
|---|---|---|---|
| 1213423 | 3/1966 | Germany | 415/209.4 |
| 2201732 | 9/1988 | United Kingdom | 415/189 |

*Primary Examiner*—Edward K. Look
*Assistant Examiner*—Mark Sgantzos
*Attorney, Agent, or Firm*—Andrew C. Hess; David L. Narciso

[57] ABSTRACT

An assembly for housing an inboard end of a stator vane in an axial flow compressor includes a shroud having a plurality of openings formed about the periphery of an outboard surface thereof, where the shroud includes at least one circumferential groove adjacent an inboard surface of the openings, and a bushing fitted into each of the openings, with the bushing including a slot in an outboard surface thereof for receiving the inboard end of the stator vane and at least one tang extending from a sidewall of the bushing, wherein the tang is positively retained within the shroud groove and radial displacement of the bushing is prevented.

14 Claims, 5 Drawing Sheets

POSITIVELY RETAINED VANE BUSHING FOR AN AXIAL FLOW COMPRESSOR

BACKGROUND OF THE INVENTION

1. Field of the Invention

The present invention relates to a stator vane in an axial flow compressor of a gas turbine engine, and, more particularly, to an assembly for housing an inboard end of a stator vane in an axial flow compressor which positively retains a bushing thereof against outward radial movement.

2. Description of Related Art

Axial flow compressors in gas turbine engines are known to include one or more rotor and stator stages for air to flow therethrough and be compressed. The stator stages include stator vanes which remain stationary, while the rotor stages have airfoils which are allowed to rotate. Although various mechanisms and assemblies have been developed to retain the outboard end of stator vanes with respect to compressor casings, little has been done to prevent outward radial movement of bushings or the like used to house the inboard end of stator vanes from the shroud of a compressor. Because more recent compressor shroud designs are normally made up of two axially split, 180° segmented shrouds that are bolted together, reliance has been placed upon the clamp load exerted on a bushing or the like from the shroud halves about the periphery of the bushing. By relying solely upon such a clamp load, however, it has been found that the bushing has a tendency to move radially outward when subjected to engine vibratory signatures and thermal cycling during engine operation.

Radial movement of a bushing retaining the stator vane inboard end is significant since it results in an outward flowpath step which causes a deficit in engine performance. It will be understood by those skilled in the art that the outboard surfaces of the bushing and the compressor shroud comprise a compressor inner gas flowpath annulus and any obstruction thereof impacts the performance of the engine. Moreover, radial movement of the bushing frequently initiates a physical interaction between the inboard surfaces of the leading and trailing edges of the stator vane and the outboard surface of the bushing. This has resulted in bushing failure and subsequent engine ingestion of the bushing, which could cause severe compressor blading damage. Such engine ingestion would also change the frequency of the stator vane, thereby resulting in air flow separation.

Accordingly, a need exists in the art for an assembly which can house the inboard end of a stator vane in the shroud of an axial flow compressor, the components of the assembly being positively retained to prevent radial displacement.

SUMMARY OF THE INVENTION

In accordance with one aspect of the present invention, an assembly for housing an inboard end of a stator vane in an axial flow compressor includes a shroud having a plurality of openings formed about the periphery of an outboard surface thereof. The shroud includes at least one circumferential groove adjacent an inboard surface of the openings. A bushing is fitted into each of the openings, with the bushing including an elongated slot in an outboard surface thereof for receiving the inboard end of the stator vane and at least one tang extending from a sidewall of the bushing. Accordingly, the tang is positively retained within the shroud groove and radial displacement of the bushing is prevented.

BRIEF DESCRIPTION OF THE DRAWING

While the specification concludes with claims particularly pointing out and distinctly claiming the present invention, it is believed the same will be better understood from the following description taken in conjunction with the accompanying drawing in which:

DETAILED DESCRIPTION OF THE INVENTION

Figure 1:
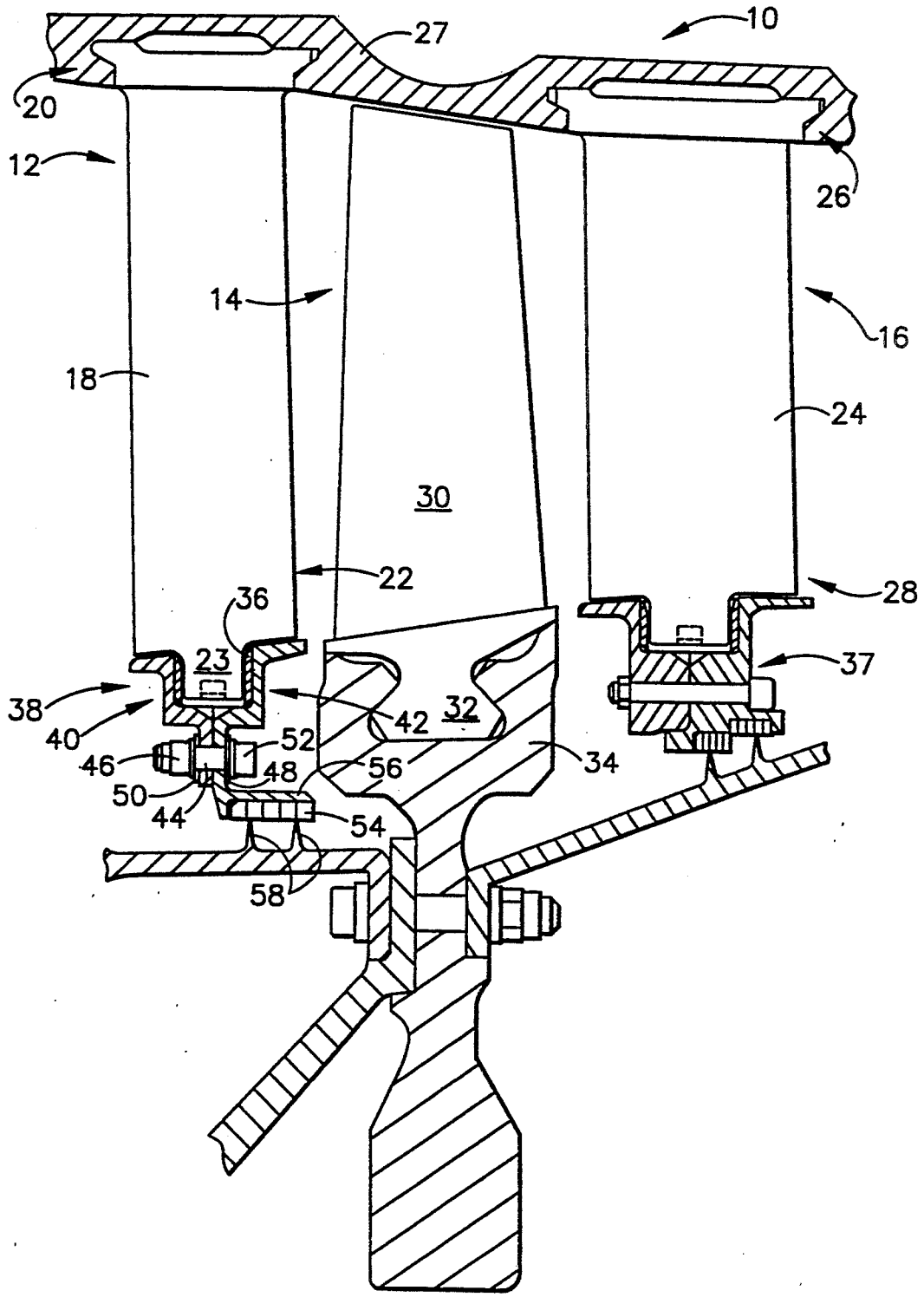
FIG. 1 is a partial sectional view of an axial flow compressor for a gas turbine engine.

Referring now to the drawings in detail, wherein identical numerals indicate the same elements throughout the figures, FIG. 1 depicts a partial sectional view of an axial flow compressor 10 of the type suitable for use in a gas turbine engine. As shown therein, a first stator stage 12, a first rotor stage 14, and a second stator stage 16 is provided in compressor 10. It will be understood by those skilled in the art that a varying number of stator and rotor stages may be provided in an axial flow compressor for a gas turbine engine.

More particularly, first stator stage 12 includes a stator vane 18 having an outboard end 20 and an inboard end 22. Likewise, second stator stage 16 also includes a stator vane 24 having an outboard end 26 and an inboard end 28. First rotor stage 14 includes an airfoil 30 having a dovetail section 32 at its inboard end which is secured to a disk 34. The outboard ends 20 and 26 of stator vanes 18 and 24 are shown generally as being retained within compressor casing 27.

Figure 2:
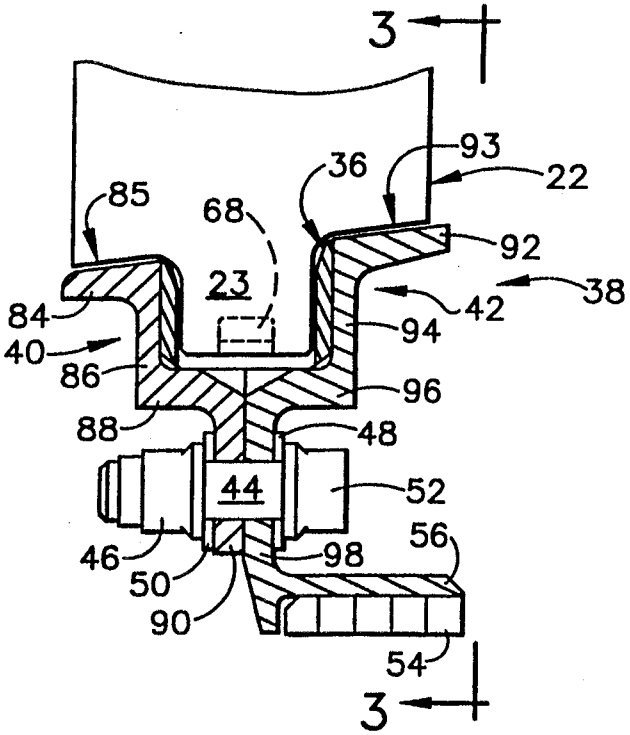
FIG. 2 is an enlarged sectional view of the inboard end of a stator vane of the compressor shown in FIG. 1 with an assembly of the present invention for housing the stator vane.

It will be understood that the present invention is concerned with the mounting of a stator vane to a shroud at its inboard end, as best seen in FIGS. 1 and 2. With respect to stator vane 18 of first rotor stage 14, a bushing 36 or other similar device is utilized to secure inboard end 22 of stator vane 18 to a shroud 38. Shroud 38 preferably is axially split, and includes a pair of 180° segmented shroud halves 40 (forward) and 42 (aft). Forward and aft shroud halves 40 and 42 are connected by a bolt 44 and nut 46 or other such similar connecting means. As seen in FIGS. 1 and 2, a pair of washers 48 and 50 may also be included between bolt head 52 and aft shroud half 42, as well as nut 46 and forward shroud half 40, respectively. A honeycomb seal 54 or other similar seal may preferably be affixed to a downstream extending flange 56 of aft half shroud 42, which in conjunction with knife edge seal rings 58 forms a labrynth seal.

Most importantly, bushing 36 is provided within a generally cylindrical-shaped opening 39 formed when forward shroud half 40 and aft shroud half 42 are connected to form shroud 38. It will be understood that there will be a plurality of such openings 39 about the outer circumference of shroud 38 in order to accommodate a number of stator vanes spaced intermittently therearound. In the prior art, bushing 36 has been held in place entirely by the clamp load exerted from the forward and aft shroud halves 40 and 42 around the periphery thereof. However, it has been found that such bushings had a tendency to move radially outward during engine operation due to engine vibratory signatures and thermal cycling.

Figure 3:
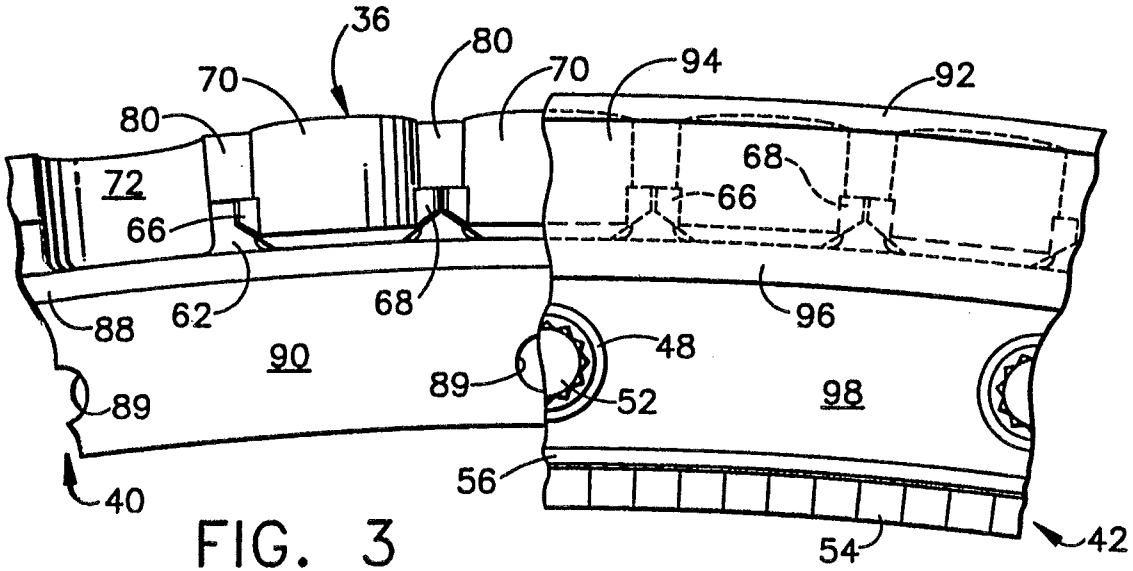
FIG. 3 is a partial split side elevational view (aft looking forward) of the assembly of the present invention depicted in FIGS. 1 and 2 where the aft shroud half is shown on the right side and the forward shroud half is shown on the left side.

In order to prevent radial movement of bushing 36, a pair of circumferential grooves 62 and 64 are preferably provided in forward and aft shroud halves 40 and 42 (although only one groove is needed). At least one tang 66, and preferably a second tang 68 (positioned opposite tang 66), is included on and extends from an outer surface of sidewall 70 of bushing 36. It will be understood from FIGS. 3–5 that tangs 66 and 68 are positioned on bushing sidewall 70 so that they are received within and positively retained by circumferential grooves 62 and 64 of forward and aft shroud halves 40 and 42.

It will further be understood from FIGS. 1–5 that cylindrical openings 39 include semi-circular vertical walls 72 and 74 and inboard horizontal surfaces 76 and 78, respectively, in forward shroud half 40 and aft shroud half 42. Accordingly, there is a series of inner vertical surfaces 80 separating semi-circular vertical walls 72 and a series of inner vertical surfaces 82 separating semi-circular vertical walls 74, where inner vertical surfaces 80 and 82 are in alignment and abut one another when forward and aft shroud halves 40 and 42 are joined. In this manner, circumferential grooves 62 and 64 are in alignment when formed within vertical surfaces 80 and 82 adjacent inboard horizontal surfaces 76 and 78. As such, tangs 66 and 68 of bushings 60 are retained within grooves 62 and 64 and thereby prevented from moving radially outward.

It will be seen that forward shroud half 40 includes a first section 84 which is substantially parallel to and spaced radially inward of a leading edge 85 of stator vane inboard end 22. A second section 86 is provided which is substantially perpendicular to and extends radially inward from first section 84, in which semi-circular openings are formed to provide semi-circular vertical walls 72. Vertical surfaces 80 and groove 62 are also formed in second section 86. A third section 88 of forward shroud half 40 is substantially perpendicular to and extends downstream of second section 86. Third section 88 is used to provide inboard horizontal surfaces 76 for bushings 36 to rest upon. A fourth section 90 is substantially perpendicular to and radially inward of third section 88, and is used to abut an adjacent section 98 of aft shroud half 42. A series of holes 89 are provided in fourth section 90 for bolt 44 to penetrate therethrough when connecting forward and aft shroud halves 40 and 42.

Aft shroud half 42, like forward shroud half 40, includes a first section 92 which is parallel to and spaced radially inward of a trailing edge 93 of stator vane inboard end 22. It will be understood that the outboard surfaces of first sections 84 and 92 of forward and aft shroud halves 40 and 42 are coincident and, in conjunction with an outboard surface 61 of bushing 36, provide an inner gas flowpath annulus for compressor 10. Aft shroud half 42 has a second section 94 which is substantially perpendicular to and radially inward of first section 92. Second section 94 has semi-circular openings formed therein to provide semi-circular vertical walls 74. Vertical surfaces 82 and groove 64 are also formed in second section 94. A third section 96 is also included which is substantially perpendicular to and extends upstream of second section 94, from which horizontal inboard surfaces 78 are provided for bushings 36 to rest thereon. A fourth section 98, which is substantially perpendicular to and extends radially inward of third section 96, is adjacent to fourth section 90 of forward shroud half 40 and includes a series of holes 99 therethrough to accommodate bolts 44. It will also be seen that fourth section 98 of aft shroud half 42 includes flange 56 extending downstream therefrom as discussed hereinabove.

Figure 4:
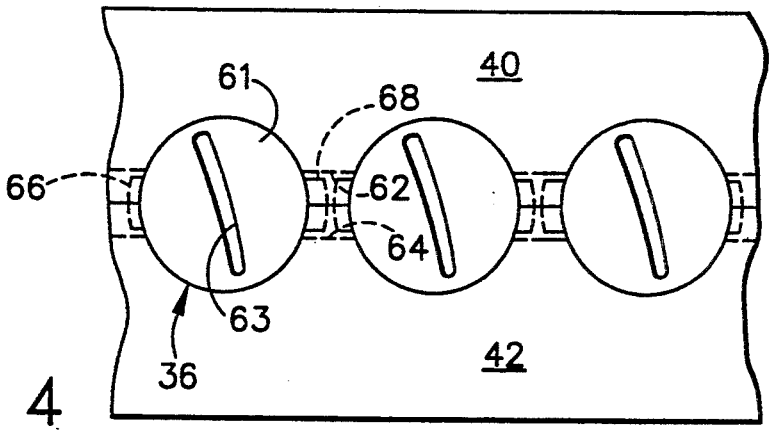
FIG. 4 is a top view of the assembly depicted in FIG. 3.
Figure 5:
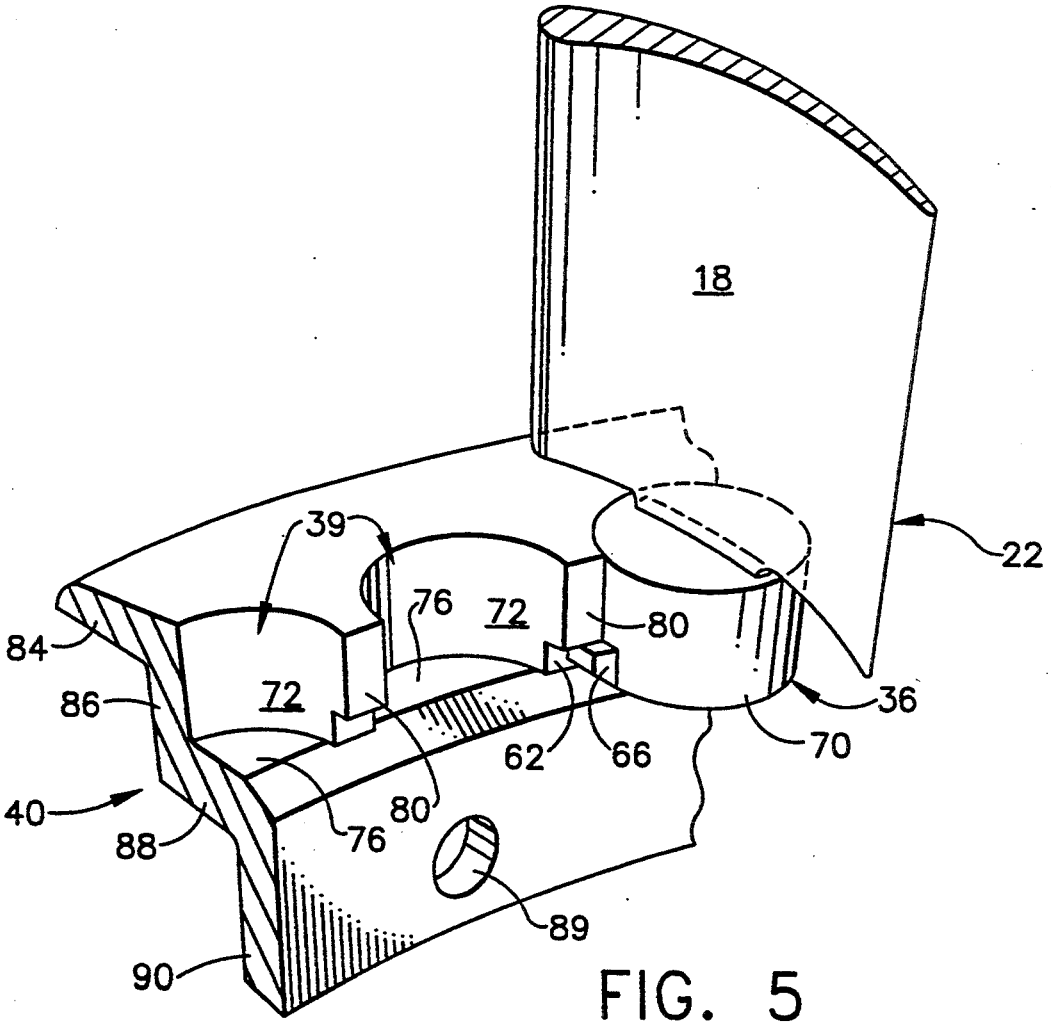
FIG. 5 is a partial perspective view of the forward shroud half depicted in FIGS. 2 and 3 along with the inboard end of a stator vane retained in one of the openings therein.
Figure 5A:
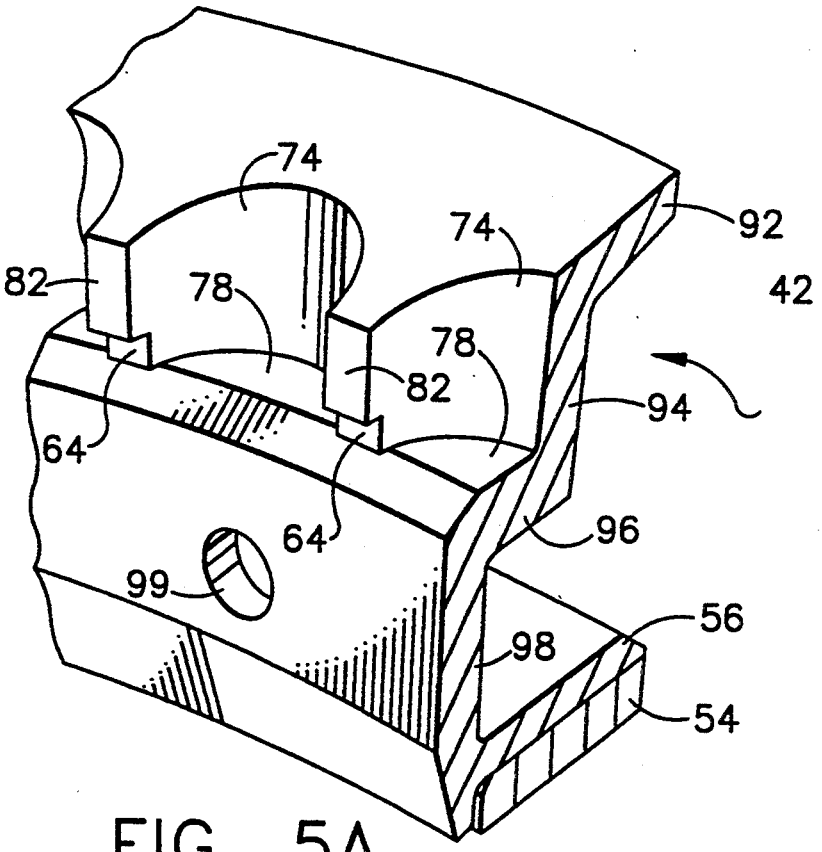
FIG. 5*a* is a partial perspective view of the aft shroud half depicted in FIGS. 2 and 3.
Figure 6:
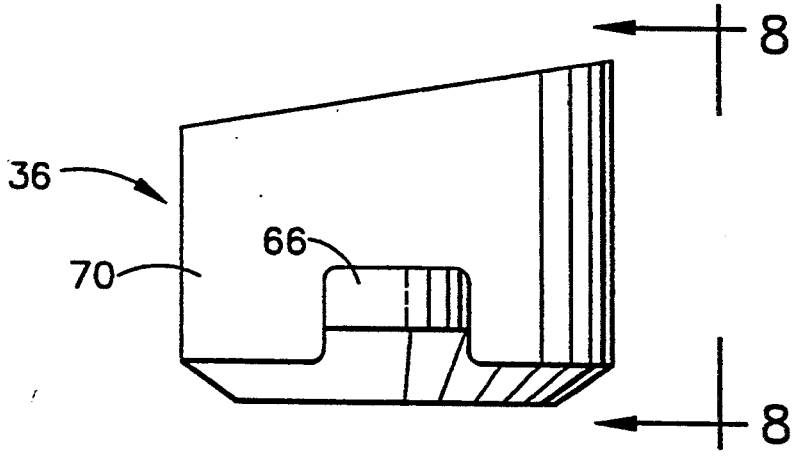
FIG. 6 is a front elevational view of the bushing in the assembly of the present invention depicted in FIGS. 2–5.
Figure 7:
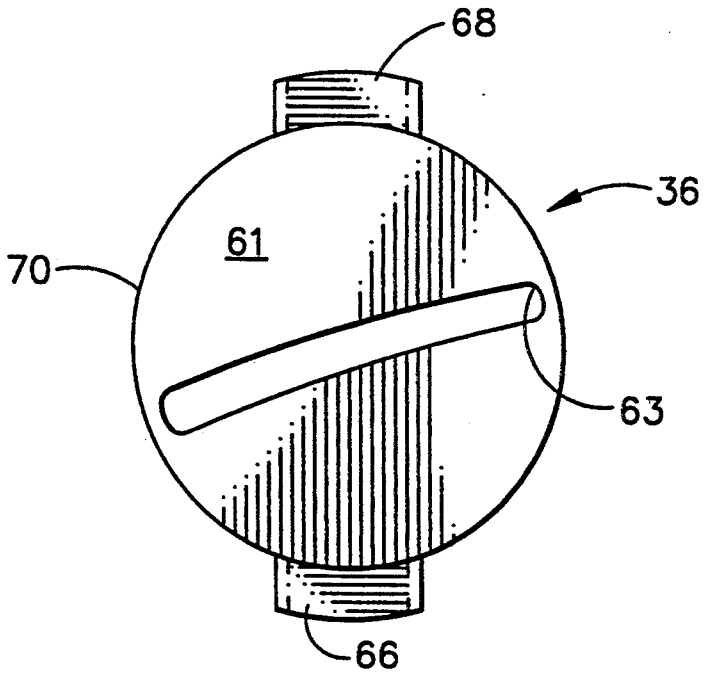
FIG. 7 is a top view of the bushing shown in FIG. 6.
Figure 8:
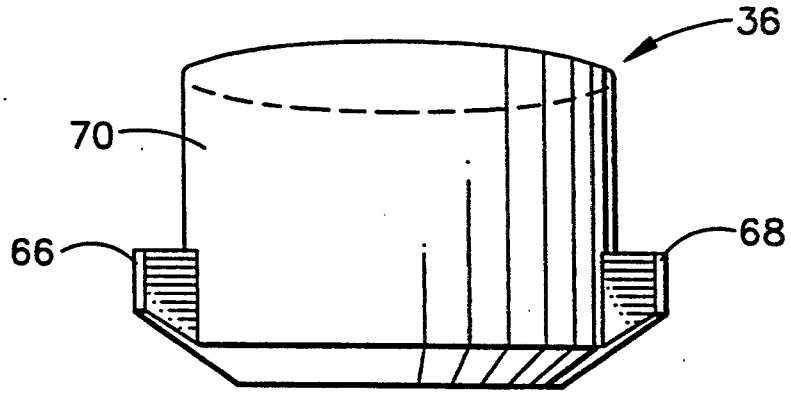
FIG. 8 is a side elevational view of the bushing depicted in FIGS. 6 and 7, where the opening in the outboard surface thereof is not shown for clarity.

It will be understood, as best seen in FIGS. 4 and 7, that outboard surface 61 of bushing 36 includes an elongated slot 63 therein to receive a portion 23 of stator blade inboard end 22, where it is retained in an interference fit. As seen in FIGS. 6 and 8, outboard surface 61 of bushing 36 is angled (i.e., not parallel to a centerline of compressor 10) in order to accommodate the differing radiuses of forward and aft shroud halves 40 and 42. This difference in radius stems from the fact that the opening at the forward end of compressor 10 is larger than the aft end in order to accommodate the flow annulus.

Since there can be various sizes and dimensions of the stator vanes in a compressor, the dimensions of the various sections comprising the forward and aft shroud halves may be adjusted, as well as the bushings retained therein, to accomodate such stator vane inboard ends. In particular, the axial length of the third sections of the forward and aft shroud halves, as well as the bushing radius, are sized so as to properly receive the stator vane. This is evidenced by a shroud assembly 37 shown in FIG. 1 with respect to second stator stage 16. Therefore, having shown and described the preferred embodiment of the present invention, further adaptations of the assembly for housing an inboard end of a stator vane can be accomplished by appropriate modifications by one of ordinary skill in the art without departing from the scope of the invention.

What is claimed is:

1. An assembly for housing an inboard end of a stator vane in an axial flow compressor, comprising:

(a) a shroud having a forward shroud member, an aft shroud member connected to said forward shroud member, and a plurality of openings formed about the periphery of an outboard surface thereof, wherein half of each opening is formed in said forward shroud member and half of each opening is formed in said aft shroud member, said shroud including a circumferential groove in at least one of said forward and aft shroud members adjacent an inboard surface of said openings; and (b) a bushing fitted into each of said openings, said bushing including a slot in an outboard surface thereof for receiving said stator vane inboard end and at least one tang extending from a sidewell of said bushing, wherein said tang is positively retained within said shroud groove to prevent radial displacement of said bushing.

2. The assembly of claim 1, further comprising a pair of aligned grooves in said forward and aft shroud members.

3. The assembly of claim 1, wherein said bushing outboard surface is coincident with said shroud outboard surface, thereby defining an inner gas flowpath annulus for said compressor.

4. The assembly of claim 1, wherein said shroud is formed from a pair of axially split, 180° segmented shrouds.

5. The assembly of claim 2, wherein said bushing sidewall has a pair of tangs extending therefrom which are positioned to be positively retained within said shroud grooves.

6. The assembly of claim 3, wherein said bushing and shroud outboard surfaces are at an angle to a centerline of said compressor.

7. The assembly of claim 1, said forward shroud member further comprising:

(a) a first section substantially parallel to and spaced from a leading edge of said stator vane inboard end;
(b) a second section substantially perpendicular to and extending radially inward of said first section;
(c) a third section substantially perpendicular to and extending downstream of said second section; and
(d) a fourth section substantially perpendicular to and extending radially inward of said third section.

8. The assembly of claim 1, said aft shroud member further comprising:

(a) a first section substantially parallel to and spaced from a trailing edge of said stator vane inboard end;
(b) a second section substantially perpendicular to and extending radially inward of said first section;
(c) a third section substantially perpendicular to and extending upstream of said second section; and
(d) a fourth section substantially perpendicular to and extending radially inward of said third section.

9. The assembly of claim 7, said aft shroud member further comprising:

(a) a first section substantially parallel to and spaced from a trailing edge of said stator vane inboard end;
(b) a second section substantially perpendicular to and extending radially inward of said first section;
(c) a third section substantially perpendicular to and extending upstream of said second section; and
(d) a fourth section substantially perpendicular to and extending radially inward of said third section.

10. The assembly of claim 9, wherein outboard surfaces of said forward and aft first sections are coincident.

11. The assembly of claim 9, wherein said forward and aft fourth sections are adjacent and substantially parallel so that they abut one another when said forward and aft shroud members are connected.

12. The assembly of claim 1, wherein said openings are cylindrical in shape.

13. The assembly of claim 9, said aft fourth section including a flange extending downstream therefrom.

14. The assembly of claim 9, wherein the radius of said bushing is approximately the axial length of said forward and aft third sections.

* * * * *